US006904648B2

(12) United States Patent
Fildan et al.

(10) Patent No.: US 6,904,648 B2
(45) Date of Patent: Jun. 14, 2005

(54) STRAP ASSEMBLY FOR LINGERIE AND BRASSIERES

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 84 days.

(21) Appl. No.: 10/436,818

(22) Filed: May 13, 2003

(65) Prior Publication Data

US 2004/0226147 A1 Nov. 18, 2004

(51) Int. Cl.[7] ..... A44B 15/00
(52) U.S. Cl. ..... 24/302; 24/198; 24/200
(58) Field of Search ..... 24/194, 196, 198, 24/200, 302; 450/86, 88

(56) References Cited

U.S. PATENT DOCUMENTS 2,721,323 A * 10/1955 Spanel et al. ..... 450/93
3,075,268 A * 1/1963 Schwartz ..... 24/200
3,290,696 A * 12/1966 Rosenzweig ..... 24/198
3,328,856 A * 7/1967 Jonas ..... 24/191
3,565,711 A * 2/1971 Block et al. ..... 156/73.5
3,587,947 A * 6/1971 Block et al. ..... 223/49
3,860,046 A * 1/1975 Goff et al. ..... 139/421
4,673,448 A * 6/1987 Bartolini ..... 24/200
5,590,443 A * 1/1997 Fildan ..... 24/200
5,661,878 A * 9/1997 Johnson, III ..... 24/200
6,056,625 A * 5/2000 Fildan ..... 24/200
6,056,626 A * 5/2000 Fildan ..... 24/200
6,059,634 A * 5/2000 Fildan ..... 24/200

* cited by examiner

*Primary Examiner*—Robert J. Sandy
(74) *Attorney, Agent, or Firm*—Herbert Dubno

(57) ABSTRACT

A slide and slide assembly for lingerie and brassieres have the end of a strap bonded to the central bar of the slide at the same side as that at which the strap is threaded around the central bar of the slide to limit slippage of the slide relative to the strap.

7 Claims, 3 Drawing Sheets

STRAP ASSEMBLY FOR LINGERIE AND BRASSIERES

FIELD OF THE INVENTION

Our present invention relates to a strap and slide assembly for lingerie and brassieres and, more particularly, to a flat assembly for such garments which has reduced slip and greater protection of the slide from separation of the strap therefrom.

BACKGROUND OF THE INVENTION

It is known to provide a slide and strap assembly wherein a garment such as a brassiere or another undergarment having adjustability of the shoulder straps, has its strap bonded to one side of a central bar of a slide such that another portion of the strap passes through the slots of the slide and the opposite side of that central bar.

The strap may loop through a ring which is bonded to one part of the garment and the end of the portion of the strip which slips through the slide may be anchored to another portion of the garment, e.g. the back thereof.

While a strip and slide assembly of this type is comparatively flat, the region at which an end of the strap is attached to the slide may rub against the body and become frayed or peel away.

OBJECTS OF THE INVENTION

It is, therefore, the principal object of the present invention to provide a strap and slide assembly for brassieres and lingerie whereby the drawbacks of earlier systems are avoided.

Another object of this invention is to provide an improved strap and slide assembly with less danger of slippage than earlier devices and wherein the tendency of the end of the strip to peel away from the slide is reduced.

SUMMARY OF THE INVENTION

These objects and others which will become apparent hereinafter are attained, in accordance with the invention in a strap and slide assembly for a garment which comprises:

a slide comprising a flat frame-shaped slide body having mutually parallel upper and lower bars, a central bar parallel to and located between the upper and lower bars and a pair of lateral limbs connected to the upper and lower bars and to the central bar at opposite ends thereof, the body being formed with an upper slot between the central bar and the upper bar and a lower slot between the central bar and the lower bar, the central bar having a flat surface lying in a plane parallel to the plane of the body on one side of the body; and a strap engaged in the slide and having an end lying against and welded to the surface, a first stretch or portion of the strap running from the end to a loop of the strap, and a second stretch or portion of the strap passing from the loop around the lower bar along an opposite side of the body from the one side, then through the lower slot around the central bar on the one side over the end, then through the upper slot and around the upper bar on the opposite side of the body, whereby an effective length of the strap is adjustable by sliding the slide along the second stretch portion.

According to the invention the surface of the central bar to which the strip end is welded or bonded is provided with roughening formations facilitating welding of that end to the surface. So that orientation of the slide is important during the welding operation, both of the opposite surfaces of the slide can be provided with such formations.

The body of the slide can be formed in one piece of a synthetic resin while the strap is a woven strap of filaments of the same synthetic resin, thereby maximizing the bond strength between the end of the strap and the body of the slide. A preferred synthetic resin is of polyamide (nylon). The central bar can be flat on the opposite side thereof provided with the roughening formation.

It has been found to be advantageous to recess those surfaces inwardly from planes of outer faces of the upper and lower bars of the slider.

The advantage of the system of the invention is that the strap which slips through the slider and with respect to which the slider is movable, protects the bonded end of the strap from peeling away from the surface of the central bar to which it is sealed. Furthermore, because the strap which is threaded through the slider rides against the end of the strap bonded to the central bar, the friction between the moving slider and the strap portion on which it rides is increased and thus the tendency to slip is reduced.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
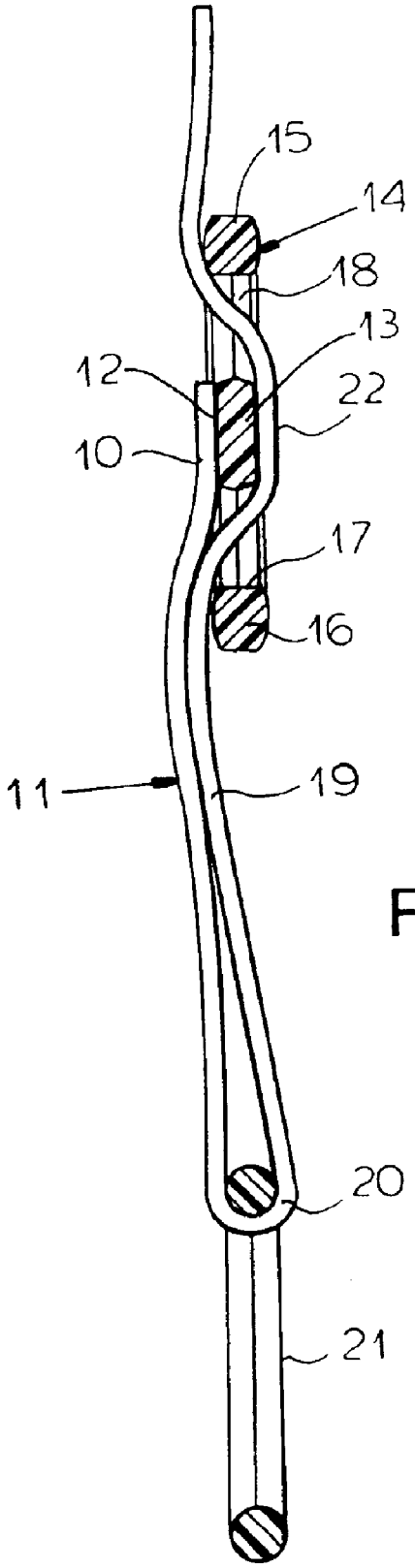
FIG.1 PRIOR ART
FIG. 1 is a cross sectional view through a strap and slide assembly in accordance with the prior art.

From FIG. 1 it will be apparent that in the prior art, a free end 10 of a strap 11 was bonded to a flat portion 12 of a central bar 13 of a slide 14 which had upper and lower bars at 15 and 16 as well as side limbs connecting those bars and a lower slot 17 and an upper slot 18 through which another pass 19 of the strap 11 was threaded.

In particular, the strap 11 had a loop 20 which extended through a ring 21 connected to the front of a brassiere or item of lingerie, the loop passing into the portion 19 of the strap which passed inwardly through the slot 17 from the same side of the slot as the end 10 was bonded thereto. The strap then passed around the central bar 13 at 22 and through the slot 18, over the shoulder of the wearer to the back of the garment. The strap and slider tended frequently to slip along the side of the bar 13 opposite that at which the end 10 was secured thereto.

Figure 2:
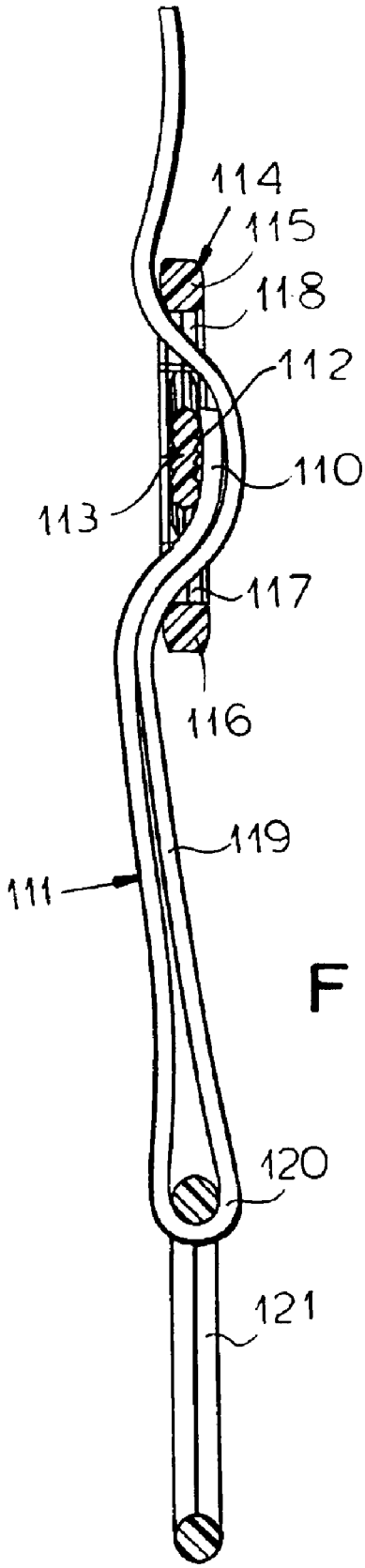
FIG. 2 is a view similar to FIG. 1 of a strap and slide assembly in accordance with the invention.
Figure 4:
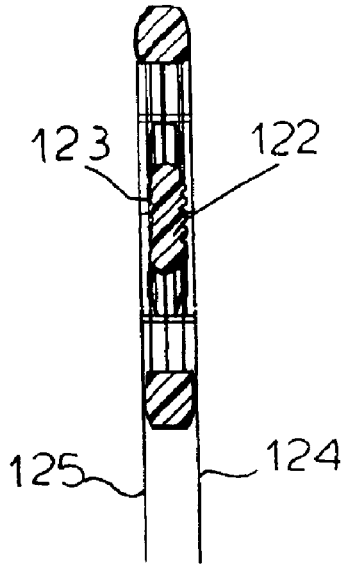
FIG. 4 is a cross sectional view through the slide taken along the line IV—IV of FIG. 3.
Figure 3:
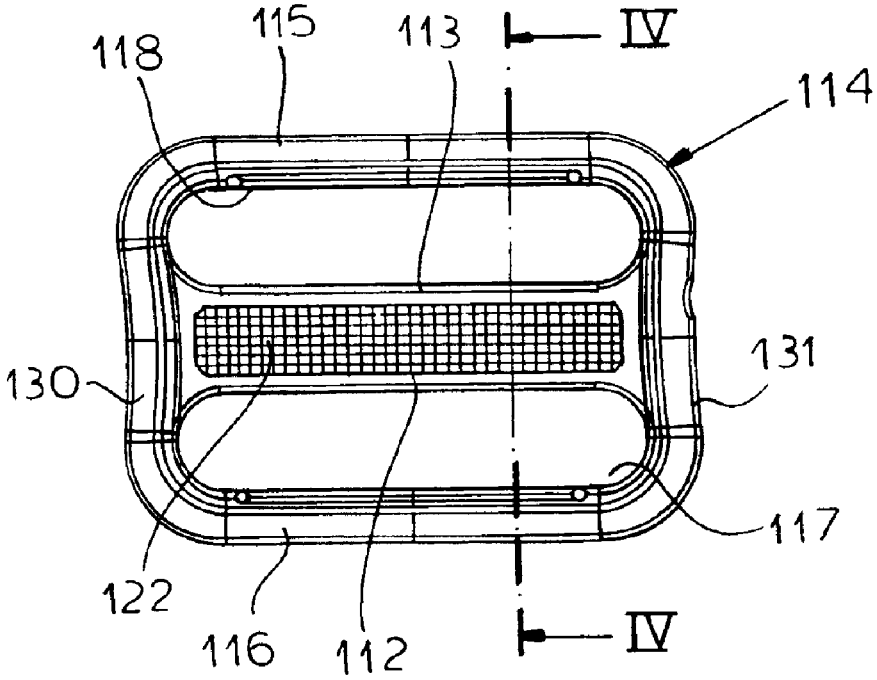
FIG. 3 is an elevational view of the slide without the strap.

As can be seen from FIG. 2, with the invention, however, the end 110 of a strap 111 is bonded to a flat side 112 of a slider 114 and passes into the loop 120 through a ring 121 from which the strap portion 119 passes through the slot 117 above the lower limb or bar 116 and then around the central bar 113 in contact with the end 110. The strap then passes through the slot 118 below the upper bar 115 over the shoulder of the wearer and to the back of the garment.

The slide 114 has, in addition to the central bar 113 and the upper bar 115 and lower bar 116, side limbs 130 and 131 delimiting the slots 117 and 118. The flat side 112 is roughened at 122 to facilitate bonding of the end 110 thereto. The injection-molded slide and the woven strap are both composed of nylon.

As can be seen from FIG. 2, similar roughenings to that at 122 may be provided at 123 on the opposite side of the central bar 113. The surfaces 122 and 123 are set inwardly from the planes 124 and 125 of the outer faces of the upper and lower bars 115, 116. The engagement between the strap portion 119 and the bonded end 110 limits slippage of the slide on the strap and the fact that the strap 119 overlies the end 110 limits peeling thereof from the slide. The surface roughening 122 ensures a good connection between the end and the central bar 113 in the welding process.

We claim:

1. Strap and slide assembly for a garment including lingerie and brassieres, said assembly comprising:

a slide comprising a flat frame-shaped slide body delimited by planes on opposite sides of said body and having mutually parallel upper and lower bars, a continuous central bar parallel to and located between the upper and lower bars and a pair of lateral limbs connected to said upper and lower bars and to said central bar at opposite ends thereof, said body being formed with an upper slot between said central bar and said upper bar and a lower slot between said central bar and said lower bar, said central bar having flat surfaces on opposite sides lying in a planes parallel to said planes of said body on said opposite sides of said body and set inwardly of said planes of said body whereby said central bar is recessed symmetrically from said planes of said body; and a strap engaged in said slide and having an end lying against and welded to one of said surfaces, a first portion of said strap running from said end through said lower slot to a loop of said strap and passing through a ring at said loop, and a second portion of said strap passing from said loop back through said lower slot over said central bar and said end welded thereto, and then through said upper slot and around said upper bar, whereby an effective length of said strap is adjustable by sliding said slide along said second portion.

2. The strap and slide assembly defined in claim 1 wherein said body is formed in one piece of a synthetic resin and said strap is a woven strap of filaments of a synthetic resin.

3. The strap and slide assembly defined in claim 2 wherein the synthetic resins of said body and said strap are the same.

4. The strap and slide assembly defined in claim 3 wherein said synthetic resin is polyamide.

5. Strap and slide assembly for a garment including lingerie and brassieres, said assembly comprising:

a slide comprising a flat frame-shaped slide body delimited by a plane on one side of said body and having mutually parallel upper and lower bars, a central bar parallel to and located between the upper and lower bars and a pair of lateral limbs connected to said upper and lower bars and to said central bar at opposite ends thereof, said body being formed with an upper slot between said central bar and said upper bar and a lower slot between said central bar and said lower bar, said central bar having a flat surface lying in a plane parallel to said plane of said body on said side of said body; and a strap engaged in said slide and having an end lying against and welded to said surface, a first portion of said strap running from said end to a boy of said strap, and a second portion of said strap passing from said loop around said lower bar alone an opposite side of said body from said one side, then through said lower slot around said central bar on said one side over said end, then through said upper slot and around said upper bar on said opposite side of said body, whereby an effective length of said strap is adjustable by sliding said slide along said second portion, said surface being provided with roughening formations facilitating welding of said end to said surface, said body being formed in one piece of a synthetic resin and said strap being a woven strap of filaments of a synthetic resin, the synthetic resins of said body and said strap being the same and polyamide, said central bar being flat on said one side and said opposite side, surfaces of said central bar being roughened on both of said sides.

6. The strap and slide assembly defined in claim 5 wherein said surfaces are recessed inwardly from planes of outer faces of said upper and lower bars and said lateral limbs.

7. Stray and slide assembly for a garment including lingerie and brassieres, said assembly comprising:

a slide comprising a flat frame-shaped slide body delimited by a plane on one side of said body and having mutually parallel upper and lower bars, a central bar parallel to and located between the upper and lower bars and a pair of lateral limbs connected to said upper and lower bars and to said central bar at opposite ends thereof, said body being formed with an upper slot between said central bar and said upper bar and a lower slot between said central bar and said lower bar, said central bar having a flat surface lying in a plane parallel to said plane of said body on said side of said body; and a strap engaged in said slide and having an end lying against and welded to said surface, a first portion of said strap running from said end to a loop of said strap, and a second portion of said strap passing from said boy around said lower bar along an opposite side of said body from said one side, then through said lower slot around said central bar on said one side over said end, then through said upper slot and around said upper bar on said opposite side of said body, whereby an effective length of said strap is adjustable by sliding said slide alone said second portion, said central bar being flat on said one side and said opposite side surfaces of said central bar being roughened on both of said sides.

* * * * *